US007797857B2

(12) United States Patent
Mattia

(10) Patent No.: US 7,797,857 B2
(45) Date of Patent: Sep. 21, 2010

(54) TRANSFORMATIONAL SHOES

(76) Inventor: Alyssa Marie Mattia, 2139 Brookshire Rd., Furlong, PA (US) 18925

( * ) Notice: Subject to any disclaimer, the term of this patent is extended or adjusted under 35 U.S.C. 154(b) by 703 days.

(21) Appl. No.: 11/709,362

(22) Filed: Feb. 22, 2007

(65) Prior Publication Data

US 2008/0201988 A1 Aug. 28, 2008

(51) Int. Cl.
*A43B 3/24* (2006.01)
*A43B 3/12* (2006.01)

(52) U.S. Cl. ..... 36/101; 36/100; 36/11.5

(58) Field of Classification Search ..... 36/101, 36/100, 15
See application file for complete search history.

(56) References Cited

U.S. PATENT DOCUMENTS 2,236,367 A * 3/1941 Gruber ..... 36/101
2,493,154 A * 1/1950 Mavrakis ..... 36/101
5,822,888 A * 10/1998 Terry ..... 36/100
7,028,420 B2 * 4/2006 Tonkel ..... 36/100
7,117,615 B2 * 10/2006 Gerber ..... 36/101
2005/0039345 A1 * 2/2005 Jones et al. ..... 36/11.5

* cited by examiner

*Primary Examiner*—Ted Kavanaugh

(57) ABSTRACT

A transformational shoe construction comprising an upper surface, lower surface (sole) and an upper-lower attachment means; said upper surface consisting of an exposed segment and a hidden segment with the upper surface joined to a lower surface (sole) by an upper-lower attachment means; said upper surface detachable from said lower surface (sole) and said upper surface capable of being turned inside-out to cause the exposed segment to become the hidden segment and the hidden segment to become the exposed segment.

1 Claim, 6 Drawing Sheets

60
100
180
160
190
170
210
120

TRANSFORMATIONAL SHOES

FIELD OF THE INVENTION

The present invention relates to shoes, and more specifically to shoes that can convert from one functional type to another functional type.

BACKGROUND OF THE INVENTION

This invention relates to shoes and more particularly to shoes that are used to cover, as a minimum, the soles of the feet while ambulating. Shoes come in a variety of functionalities, designs, sizes, shapes, colors, and materials of construction. Shoes, for the simplicity of this application, include flip-flops, dress shoes, sneakers, boots, sandals, beach shoes, moccasins, wooden shoes, high heels, sock shoes, tap shoes, toe shoes, boat shoes and any other structure intended to be placed on or around a foot, hoof, paw or flipper. Shoes are the coverings for feet which generally come in contact with the surfaces on which a person walks, runs, ambulates, scampers or moves from one place to another on. Shoes may have heels or raised areas on their soles towards the front, middle or rear.

Known shoes generally comprise a first area on the upper surface which is softer and more flexible than the lower surface (sole). Shoes may be constructed of leathers, plastics, woods, plants, papers, foams, fabrics, canvass, fibers, hairs, skins, rubbers, glass, metal, cloth, gels, water, and similar materials and/or combinations thereof. Shoes may be of solid construction or may contain spaces of air, water, gels, foam, fiber, liquids or similar materials or may contain combinations thereof.

Despite the fact that shoes have been produced for centuries, there still exists the need for better, more cost-saving, novel, and new improved types to satisfy an ever-changing world.

Thus, there remains a need for an improved, new, innovative, novel shoe type, the subject of this patent submission.

SUMMARY OF THE INVENTION

The present invention includes shoes that have a means to be changed from one type to another type and describes the method by which the change can be effected. According to one exemplary embodiment, the invention provides a shoe comprising an upper portion and a lower portion (sole) such that one type shoe can be transformed into another type shoe with another upper portion but with the same lower portion (sole).

In another exemplary embodiment of the invention, a shoe is presented with full upper portion and a lower portion (sole) that can be transformed into another type of shoe by detaching the full upper portion and inverting the upper portion which instantly becomes another partial upper portion but with the same lower portion (sole).

The invention also provides a method of transforming one type of shoe presentation to another type of shoe presentation. Another embodiment of the method according to the present invention includes a method of transforming one color of an upper portion into another color of the upper portion. Yet another embodiment of the method according to the present invention includes a method of transforming one design of an upper portion into another design of the upper portion.

DESCRIPTION OF THE FIGURES

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description that follows taken in conjunction with the accompanying drawings in which:

DETAILED DESCRIPTION OF THE INVENTION

This invention will now be described with reference to specific embodiments selected for illustration in the figures. It will be appreciated that the spirit and scope of this invention is not limited to the embodiments selected for illustration. Instead, the scope of this invention is defined separately in the appended claims. Also, it will be appreciated that the drawings are not rendered to any particular proportion or scale.

The present invention includes shoes and different types, functionalities, colors or presentations.

Figure 1:
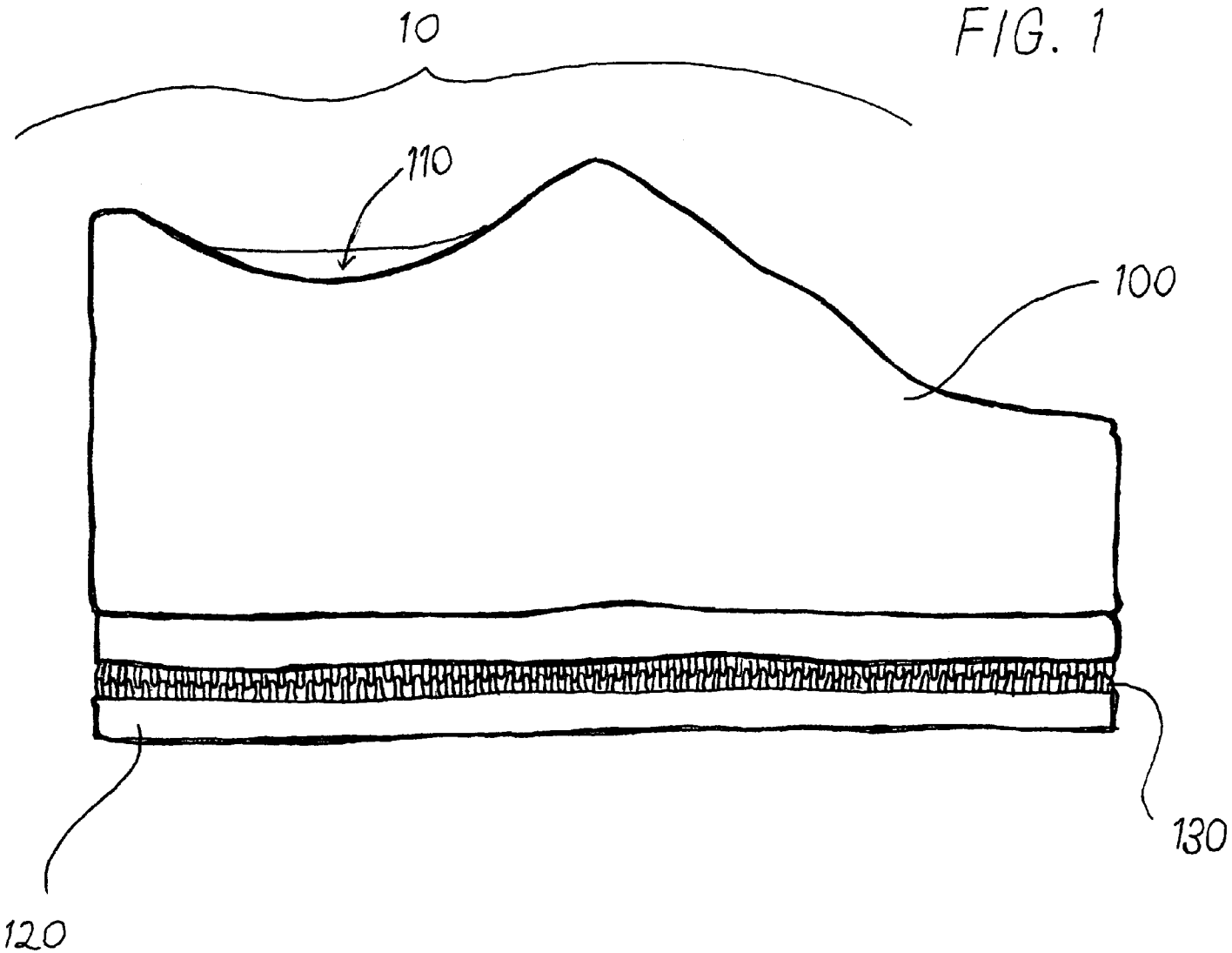
FIG. 1 is a side view of a portion of one embodiment of the present invention in which the upper surface shown is presented as a full design.

FIG. 1 shows such a shoe embodiment of the present invention, generally designated by the numeral "10". The shoe embodiment 10 has an upper surface 100 that is of a full design and includes an open area 110 for the insertion of a foot into the upper surface. More specifically, shoe embodiment 10 illustrates the upper surface 100 attached to the lower surface (sole) 120 by an upper-lower surface attachment means 130. The shoe embodiment 10 has the general appearance of a shoe as depicted in FIG. 1 however, said appearance and functionality may be changed by activating the upper-lower surface attachment means 130 causing the upper surface 100 to detach from the lower surface (sole) 120 and allowing the upper surface 100 to be turned inside out and re-attached to the lower surface (sole) 120 to give another appearance and functionality.

Generally, the upper surface 100 may be constructed of leather, plastics, wood, plants, paper, foam, fabric, canvass, fiber, hair, skin, rubber, glass, metal, cloth, gels, water, and similar materials and/or combinations thereof; however, softer materials such as leather, plastics, fabric, canvass, skin, rubber, and similar materials may be preferred. Generally the upper-lower attachment means 130 may be constructed of leather, plastics, wood, plants, paper, foam, fabric, canvass, fiber, hair, skin, rubber, glass, metal, cloth, gels, water, and similar materials and/or combinations thereof; however, plastics, metal, fabric, rubber, and similar materials may be preferred. Generally, the lower surface (sole) 120 may be constructed of leather, plastics, wood, plants, paper, foam, fabric, canvass, fiber, hair, skin, rubber, glass, metal, cloth, gels, water, and similar materials and/or combinations thereof; however, harder materials such as leather, plastics, wood, rubber, and similar materials may be preferred.

Figure 2:
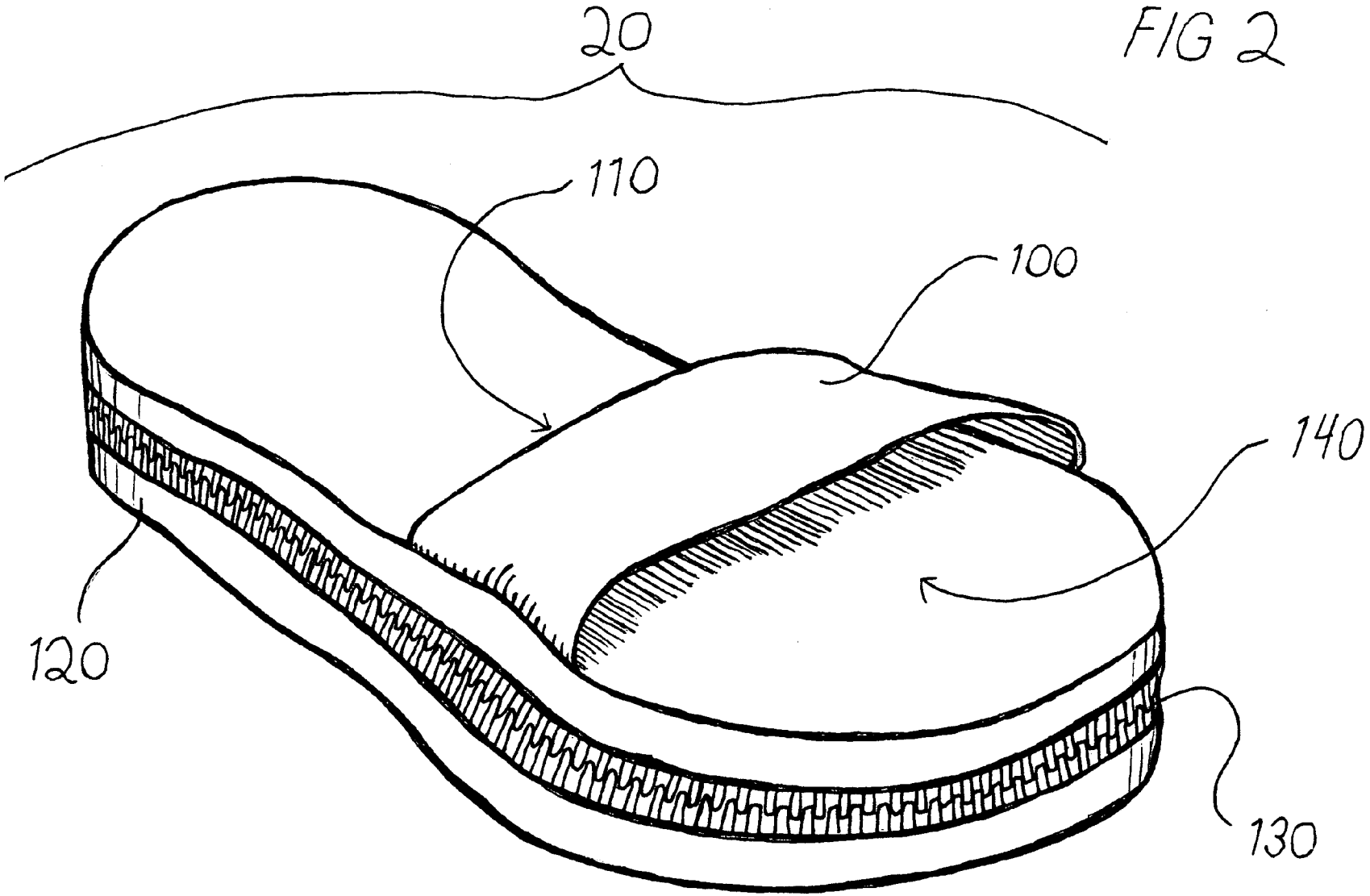
FIG. 2 is an illustration of the embodiment of FIG. 1 with partial design upper surface but with an exaggerated view of the upper-lower attachment means for illustration purposes.

In an exemplary shoe embodiment, generally designated by the numeral "20" In FIG. 2, there is shown the upper-lower attachment means 130 connecting the upper surface 100 with the lower surface (sole) 120. Shown also are open area 110 for the placement of a foot and also toe opening 140 for the exposure of toes. The upper-lower attachment means 130 is preferably a zipper structure that is continuous around the horizontal outer circumference or perimeter of the shoe 20 upper-lower attachment means 130.

Figure 3:
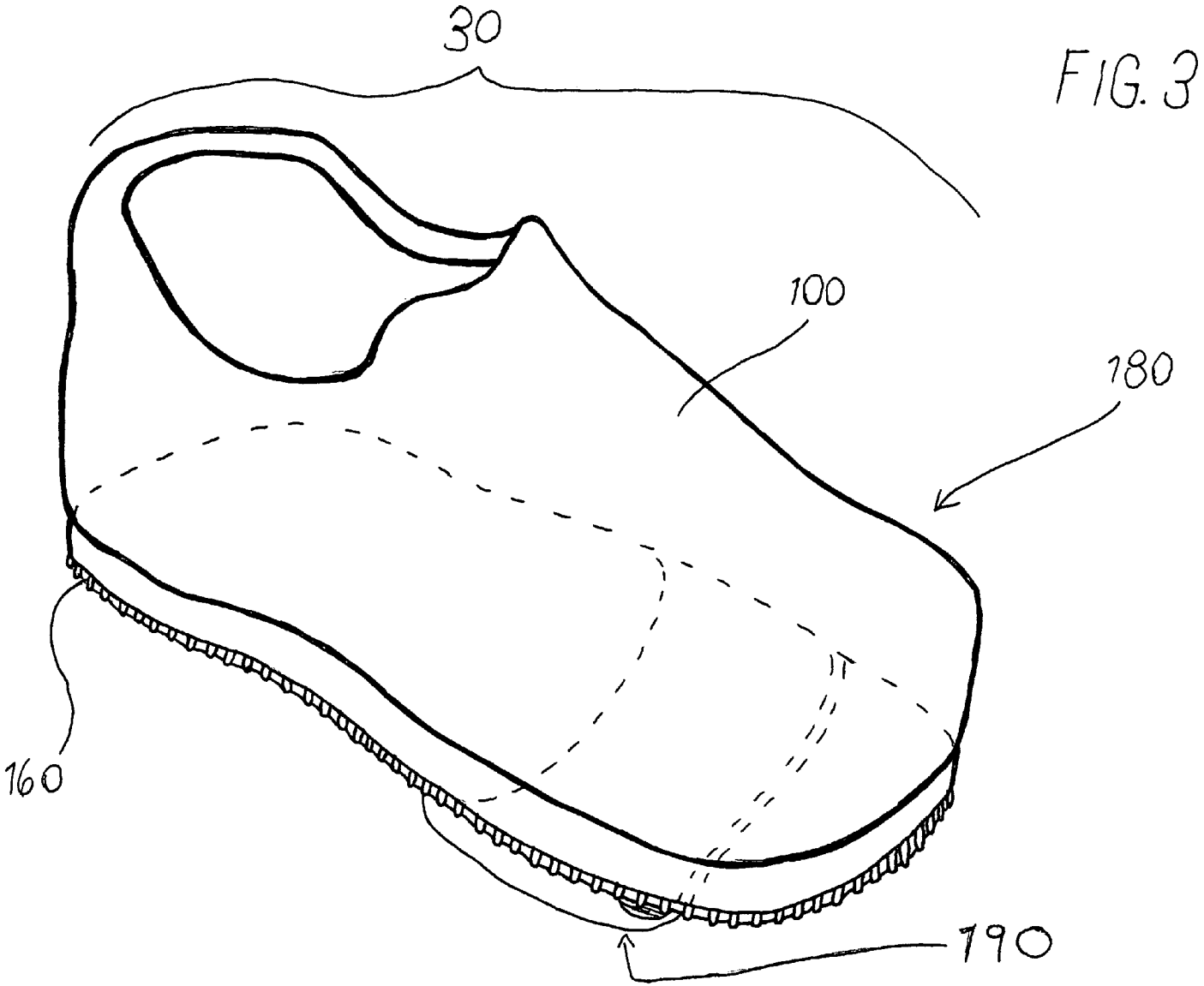
FIG. 3 is an illustration of an upper portion of the embodiment detached from the lower portion of the present invention in which one surface is a full design and the opposite surface is a partial design.

FIG. 3 shows an embodiment, generally designated by the numeral "30," of a structure the upper surface 100 consisting of two segments, the exposed segment 180 and the hidden segment 190. In this presentation, the exposed segment 180 is a full segment and the hidden segment 190 is a partial segment. Shown also is the first-half member 160 of the upper-lower attachment means which when joined to a second-half member of the upper-lower attachment means will hold the upper surface to a lower surface (sole).

Figure 4:
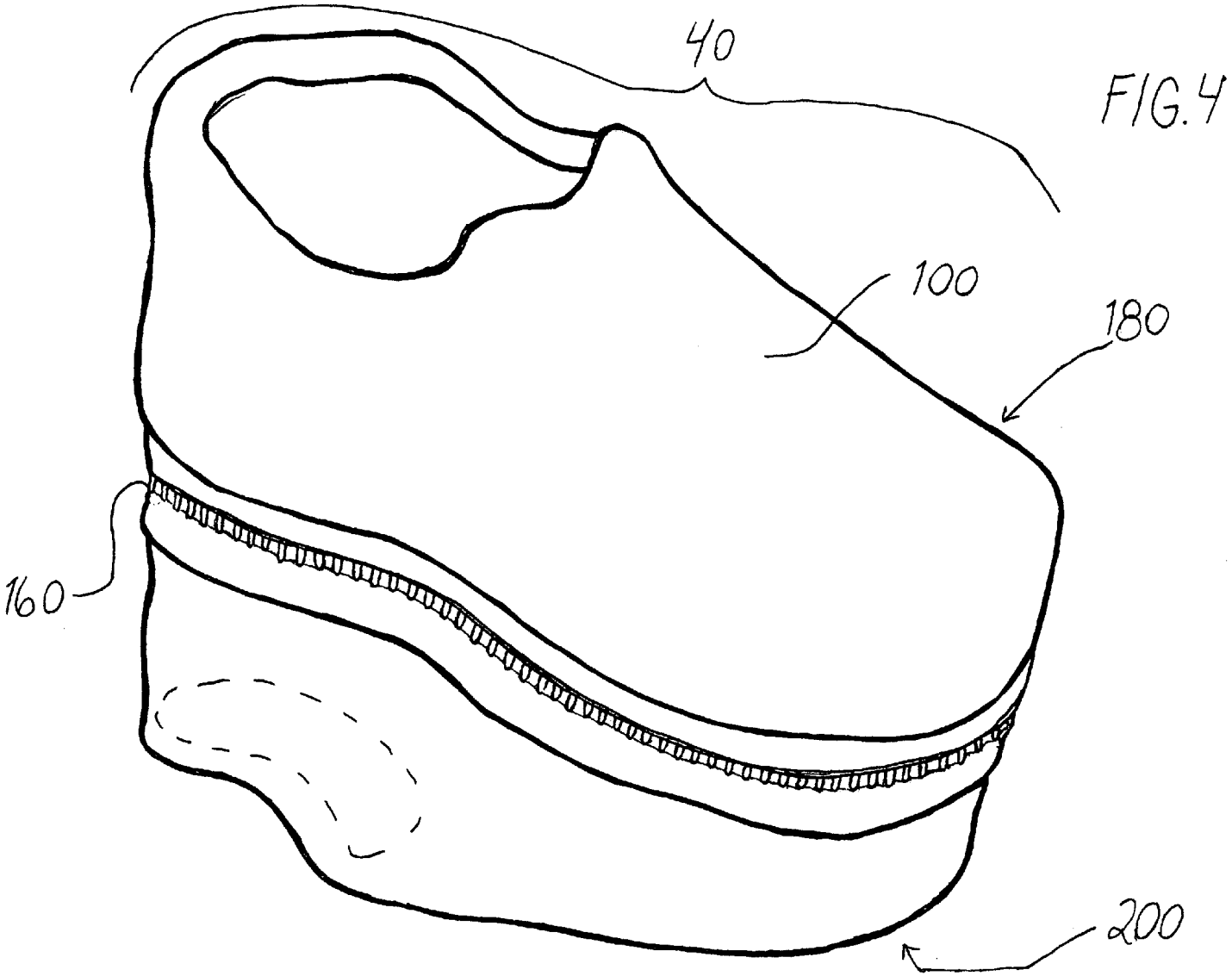
FIG. 4 is an illustration of an upper portion of the embodiment detached from the lower portion of the present invention in which one surface is a full design and the opposite surface is a full design.

FIG. 4 shows yet another exemplary embodiment of the present invention, generally designated by the numeral "40," which is essentially similar to the presentation in FIG. 3. Shown is an upper surface 100 structure consisting of two segments, the exposed segment 180 and a similar hidden segment 200. In this presentation, the exposed segment 180 is a full segment and the similar hidden segment 200 is also a full segment. Shown also is the first-half member 160 of the upper-lower attachment means which when joined to a second-half member of the upper-lower attachment means will hold the upper surface to a lower surface (sole).

Figure 5:
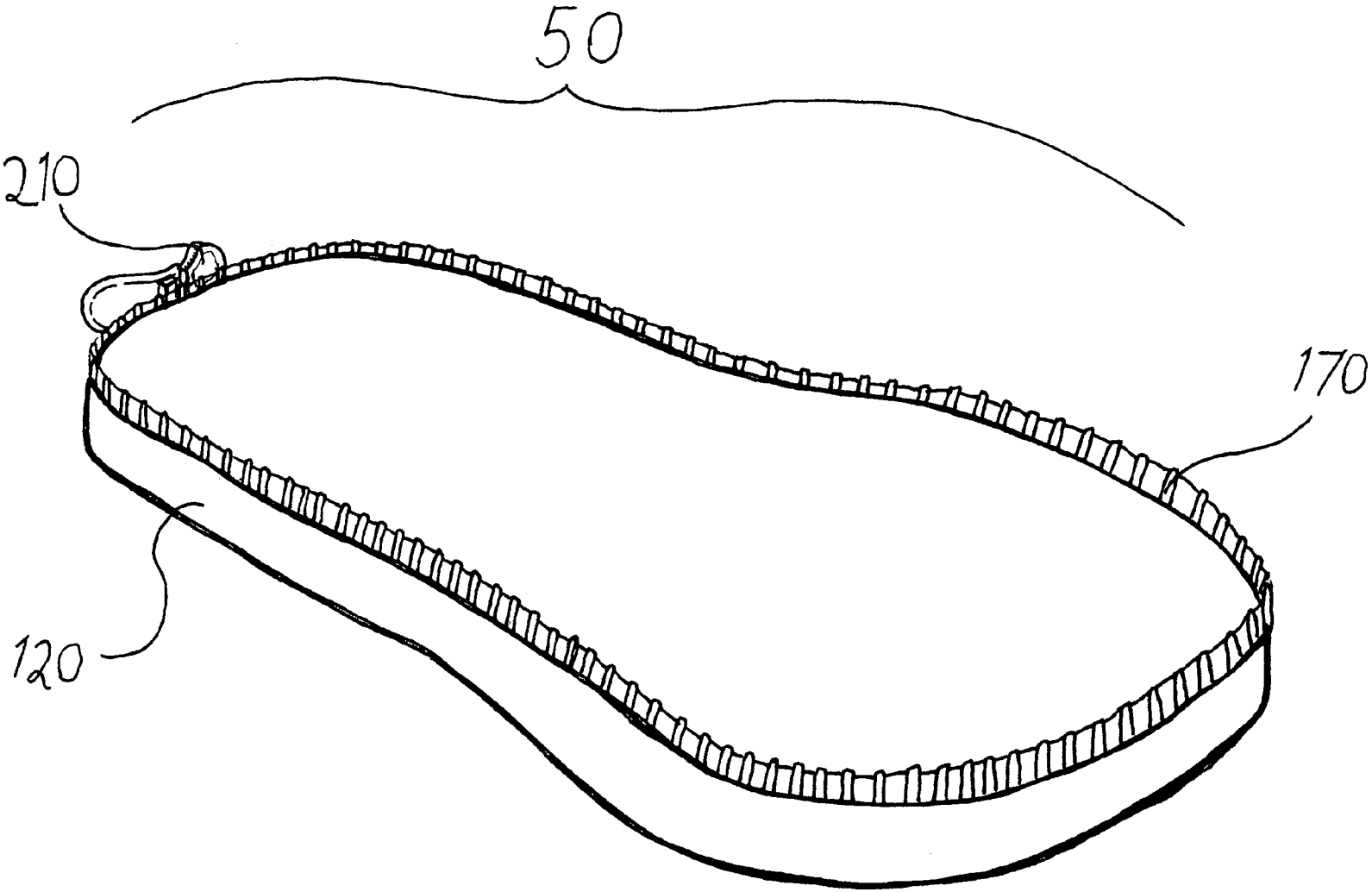
FIG. 5 is an illustration of a lower portion of yet another exemplary embodiment in which the second half of the upper-lower attachment means is illustrated.

FIG. 5 shows yet another embodiment, generally designated by the numeral "50," wherein the lower surface (sole) 120 has attached to it the second-half member 170 of the upper-lower attachment means which when joined to a first-half member of the upper-lower attachment means by use of an upper-lower attachment connecting device 210 will hold the upper surface to the lower surface (sole).

Figure 6:
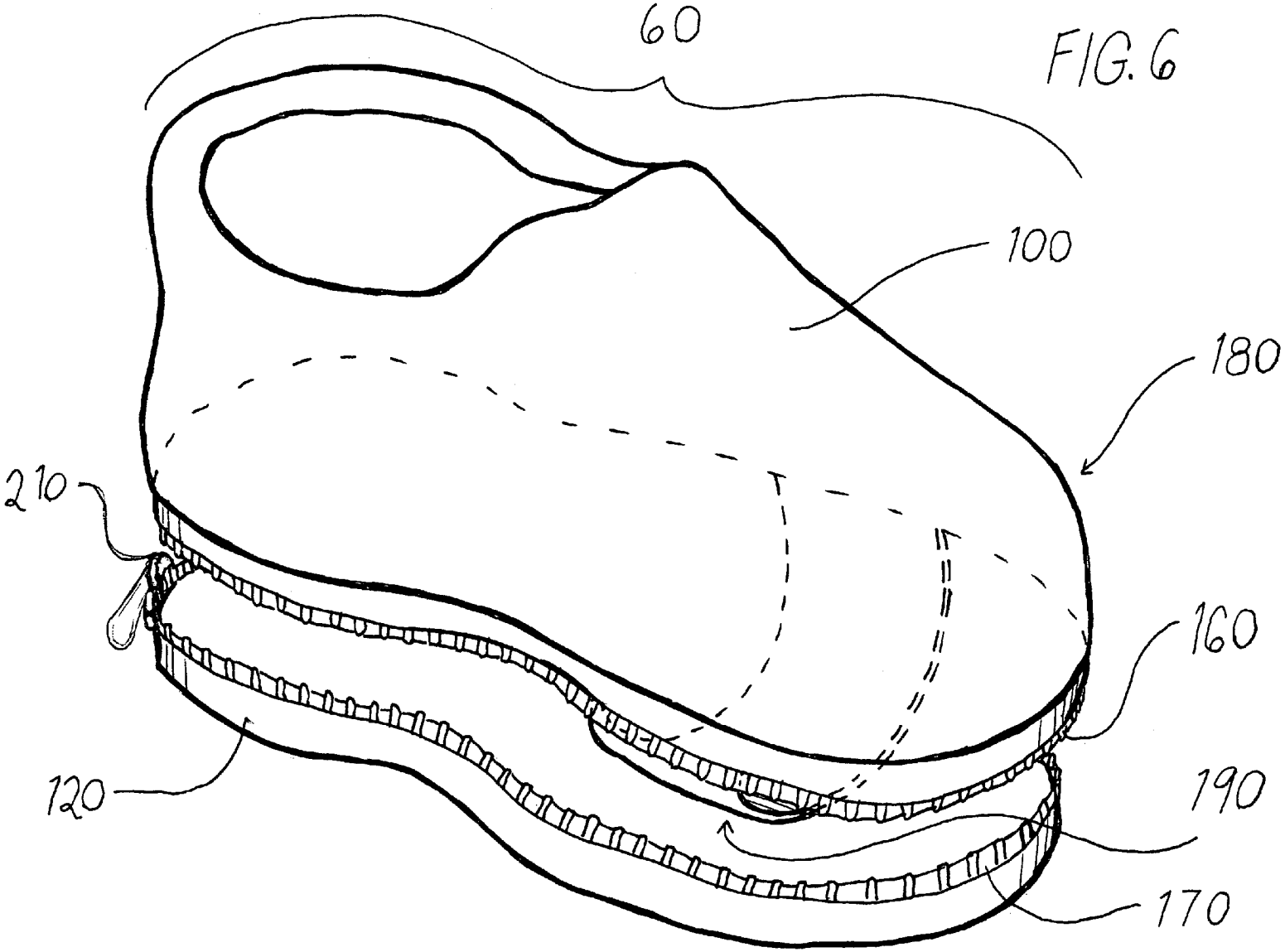
FIG. 6 is an illustration of the embodiment with a full design upper portion on the top and a partial design upper portion on the bottom nestled in the recess cavity of the lower portion.

FIG. 6 shows another version of the embodiment that is generally designated by the numeral "60." Embodiment 60 is an exploded view of a transformational shoe consisting of: an upper surface 100, the upper surface 100 consisting of an exposed full segment 180 and a hidden partial segment 190; a lower surface (sole) 120; and an upper-lower attachment means consisting of a first-half member 160 of the upper-lower attachment means attached to the upper surface 100 and a second-half member 170 of the upper-lower attachment means attached to the lower surface (sole) 120 having attached thereon an upper-lower attachment connecting device 210 which when used will join a first-half member 160 of the upper-lower attachment means to a second-half member 170 of the upper-lower attachment means.

The invention also includes a method of forming a transformational shoe. The method comprises the steps of fabricating an upper surface, a lower surface and an upper-lower attachment means. The upper surface consists of an exposed segment and a hidden segment. The fabricated segments are attached to each other by bonding, gluing, sewing, melting or other means of attachment. After the segments are attached, the first-half of an upper-lower attachment means (such as the first-half of a zipper) is attached to the perimeter of the area where the segments are joined together. The lower surface (sole) is fabricated and the second-half of the upper-lower attachment means (such as the second-half of a zipper) is attached around its perimeter. The upper surface and lower surface (sole) structures are then attached by joining the two halves of the upper-lower attachment means (such as zipping together the two halves of the zipper).

Accordingly, while illustrated and described herein with reference to certain specific embodiments, the present invention is not intended to be limited to the embodiments and details shown. Rather, the appended claims are intended to include embodiments and modifications that may be made to these embodiments and details, which are nevertheless within the true spirit and scope of the present invention.

REFERENCES CITED

| U.S. Patents | | |
|---|---|---|
| 7,117,614 | Oct. 10, 2006 | Tonkel |
| 7,032,327 | Apr. 25, 2006 | Tartaglia et al |
| 6,905,127 | Jun. 14, 2005 | Lester |
| 6,805,363 | Oct. 19, 2004 | Hernandez |
| 6,634,656 | Oct. 21, 2003 | Gervason |
| 6,631,570 | Oct. 14, 2003 | Walker |
| 5,924,902 | Jul. 20, 1999 | Burns et al |
| 5,848,484 | Dec. 15, 1998 | Dupree et al |
| 5,737,853 | Apr. 14, 1998 | Smejkal |
| 5,675,916 | Oct. 14, 1997 | Lewis |
| 5,381,610 | Jan. 17, 1995 | Hanson |
| 5,293,701 | Mar. 15, 1994 | Sullivan |
| 5,087,385 | Jan. 28, 1992 | Halford |
| 4,998,329 | Mar. 12, 1991 | Boros |
| 4,928,982 | May 29, 1990 | Logan |
| 4,839,948 | Jun. 20, 1989 | Boros |
| 4,450,033 | May 29, 1984 | Connelly |
| 4,363,177 | Dec. 14, 1982 | Boros |
| 4,114,295 | Sep. 19, 1978 | Schaefer |
| 3,955,293 | May 11, 1976 | Benedict |

What is claimed:

1. A convertible shoe comprising:

an upper having an exposed upper segment that substantial covers a wearer's foot, the upper having a lower perimeter edge, a first half member of an upper-sole attachment means attached and extending around the entire lower perimeter edge, and a hidden lower segment that covers only a portion of the wearer's foot and is attached to a bottom edge of the first half member of the upper-sole attachment means so as to extend below the wearer's foot when in use;

a sole having an upper perimeter edge, a second half member of the upper-sole attachment means extending around the entire perimeter edge of the sole and cooperates with the first half member to join the upper and the sole together;

whereby the upper is capable of being removable detached from sole by the upper-sole attachment means and turned inside-out and reattached so as to reverse the positions of the exposed upper segment and the hidden lower segment such that the exposed upper segment now extends below the wearer's foot and is hidden from sight and the hidden lower segment now extends over the wearer's foot so as to be exposed, wherein the exposed upper segment of the upper is different in design, size and shape from the hidden segment of the upper.

* * * * *